United States Patent [19]

Scott

[11] 4,308,420

[45] Dec. 29, 1981

[54] ELECTRICAL APPARATUS WITH CONVECTIVELY COOLED BUSHING CONNECTOR

[75] Inventor: Paul D. Scott, Washington, Pa.

[73] Assignee: McGraw-Edison Company, Rolling Meadows, Ill.

[21] Appl. No.: 130,030

[22] Filed: Mar. 13, 1980

[51] Int. Cl.[3] ..... H01B 17/26

[52] U.S. Cl. ..... 174/15 BH; 174/18

[58] Field of Search ..... 174/15 BH, 16 BH, 18, 174/31 R, 142, 143, 152 R, 153 R

[56] References Cited

U.S. PATENT DOCUMENTS

| | | | |
|---|---|---|---|
| 864,709 | 8/1907 | Thomas et al. | 174/15 BH |
| 1,097,552 | 5/1914 | Kramer | 174/15 BH X |
| 1,129,466 | 2/1915 | Fortescue | 174/15 BH X |
| 1,304,230 | 5/1919 | Wilkinson | 174/31 R X |
| 1,493,262 | 5/1924 | Hammond, Jr. | 174/15 BH |
| 1,706,810 | 3/1929 | Paul | 174/15 BH X |
| 1,905,751 | 4/1933 | Rankin | 174/15 BH X |
| 2,113,421 | 4/1938 | Camilli et al. | 174/15 BH X |
| 2,130,888 | 9/1938 | Marshall | 174/15 BH |
| 3,143,591 | 8/1964 | Flamand | 174/15 BH X |
| 3,626,079 | 12/1971 | Keen, Jr. et al. | 174/15 BH |

FOREIGN PATENT DOCUMENTS

| | | | |
|---|---|---|---|
| 59669 | 10/1925 | Sweden | 174/31 R |

*Primary Examiner*—Laramie E. Askin

*Attorney, Agent, or Firm*—James A. Gabala; Jon C. Gealow; Roy A. Ekstrand

[57] ABSTRACT

A conductive bushing connector includes an elongated metal stud having a center axial passage, a plurality of transverse apertures, and threaded portions at each end. A pair of insulative housings assembled on opposite sides of a transformer enclosure each overlying the metal stud and abutting the wall of the transformer enclosure form a cavity surrounding the metal stud. A pair of threaded end terminals cooperate with the threaded end portions of the metal stud to secure the entire assembly. Each interface of the assembly is provided with resilient sealing members which are maintained in compression by the end terminals. The insulative housing within the transformer enclosure includes a plurality of fluid convection apertures.

2 Claims, 8 Drawing Figures

FIG. 1
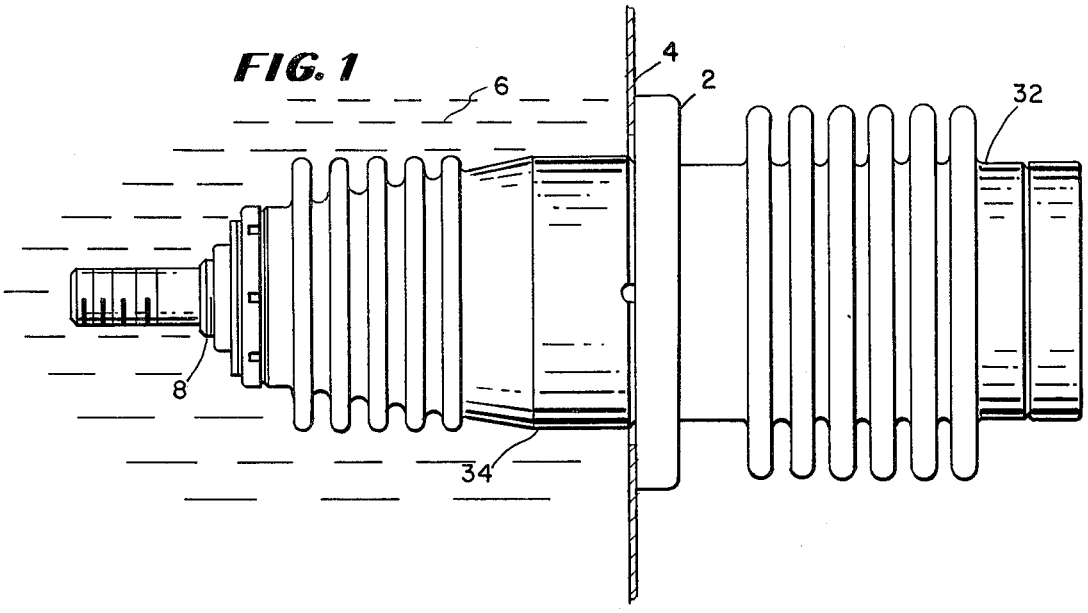
FIG. 2
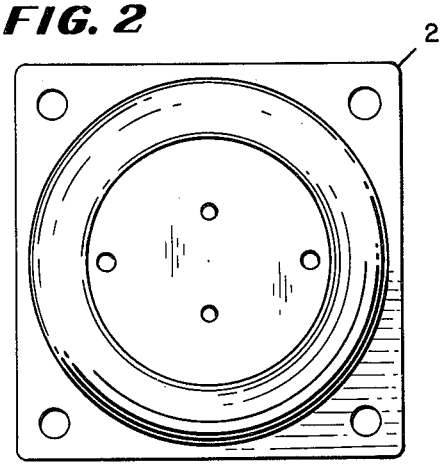
FIG. 3
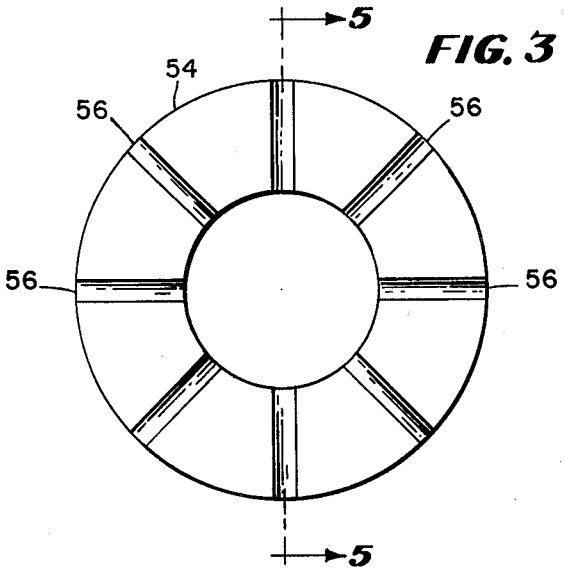
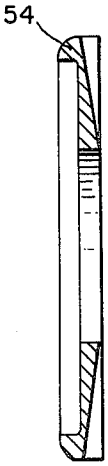
FIG. 5

ELECTRICAL APPARATUS WITH CONVECTIVELY COOLED BUSHING CONNECTOR

BACKGROUND OF THE INVENTION

This invention relates generally to electrical transmission devices and particularly to the bushings provided therein for passing a current-bearing conductor through the metal enclosure surrounding those devices which operate within a reservoir of dielectric fluid.

In electrical power distribution systems, many components such as distribution transformers are located at points remote from other system components with interconnections being supplied by networks of transmission lines. Because such system components are used in the distribution of electrical power to consumers, they are expected to handle large operating currents. Distribution transformers, for example, are located at various points within the power distribution network and provide a change of operating voltage from the higher potential main supply to a lower potential consumer supply. Generally, power line distribution transformers are situated within metal housings or enclosures and are immersed within a dielectric fluid such as oil. The oil provides both cooling of the transformer windings and core as well as increased electrical insulation and protection from moisture. The transformer windings are electrically connected to the remainder of the system external to the enclosure by conductors passing through apertures in the metal enclosure. The conductors passing through the enclosure are, of course, electrically insulated from the enclosure by interposed bushing structures which take a number of forms in the art, such as porcelain bushings. Unfortunately this electrical isolation usually produces thermal isolation, such that the dielectric bushing or insulator reduces the ability of the conductor to dissipate the heat generated by the conduction of electrical current.

Because the reliability of both insulators and electrical devices may be reduced by excessive heating, practitioners in the art have endeavored to reduce the operating temperature of such bushing enclosed conductors by providing various cooling means. One rather straight-forward solution envolves simply enlarging the conductor size, thereby providing a greater heat capacity, lower resistance, and greater heat dissipating area. A more effective heat dissipation system is provided by structures which immerse a portion of the conductor in the cooling dielectric fluid of the transformer. A still better system of heat dissipation is provided by using circulation of the dielectric fluid around the current-bearing conductor by either a forced flow or convection. The structures utilizing convective flow for cooling rather than forced flow have particular advantage in power distribution transformers or other remotely located equipment because it is usually difficult to provide a reliable source of fluid pressure.

While structures embodying one or more of the preceding improvements have provided enhanced current carrying capability, some improvement is still desired. One problem of previous systems arises because the heat produced by a conductor bearing a large current is, of course, caused by resistance within the conduction path. In structures of the type used to interconnect the internal transformer portions to the remainder of the system, the total conductive path typically includes a group of several separate conductive parts fastened together by mechanical fasteners such as threaded combinations. Because of any number of variables arising during the manufacturing of components, such as tolerances and inconsistencies in plating and finishing, a high resistance may exist in the assembled connector which is somewhat localized. When this connector is subjected to a substantial electrical current, the localized resistance produces a "hot spot"; that is, a portion of the connector becomes heated substantially more than the remainder of the connector. Because the exact location of such hot spots in assembled connectors is in many cases random, it is desirable to provide a cooling system for the connector in which the flow pattern of the dielectric fluid can increase in the area of such hot spots.

Accordingly, it is an object of the present invention to provide an improved connector bushing for use in a transformer enclosure of the like which makes optimum use of the supply of cooling dielectric fluid. It is more specific object of the present invention to provide an improved bushing in which the flow of cooling fluid varies in response to temperature differences between portions of the connector bushing.

SUMMARY OF THE INVENTION

A conductive bushing connector for facilitating electric current passage between the interior and exterior of a dielectric fluid filled metallic enclosure comprises an elongated central conductor defining first and second end portions, an axial passage, and a first plurality of passages oriented transversely to the axial passage. First and second terminal means make electrical connections to the first and second end portions respectively; and insulative housing means define an axial length sufficient to enclose a substantial portion of the elongated central conductor. The insulative housing means define an outer wall portion, and an interior cavity overlying a portion of the elongated central conductor. The outer wall portion defines a second plurality of passages between the interior cavity and the exterior of the insulative housing means. The first and second pluralities of passages and the interior cavity of the insulative housing means cooperate to provide a plurality of fluid convection paths permitting the dielectric fluid to circulate about the elongated central conductor in a convective flow pattern which varies in response to the temperature gradients in and about the elongated central conductor.

BRIEF DESCRIPTION OF THE DRAWINGS

FIG. 1 is a side elevation view of the preferred embodiment of the oil filled condenser bushing of this invention.

FIG. 2 is an elevational view of the mounting plate used at the center of the bushing.

FIG. 3 is an elevational view of a spacing washer used at an end of the bushing.

FIG. 5 is a cross-sectional view, taken on the line 5—5 of FIG. 3, of the spacing washer utilized at the left end of the condenser bushing assembly as shown in FIG. 4.

DETAILED DESCRIPTION OF THE PREFERRED EMBODIMENT

Figure 4:
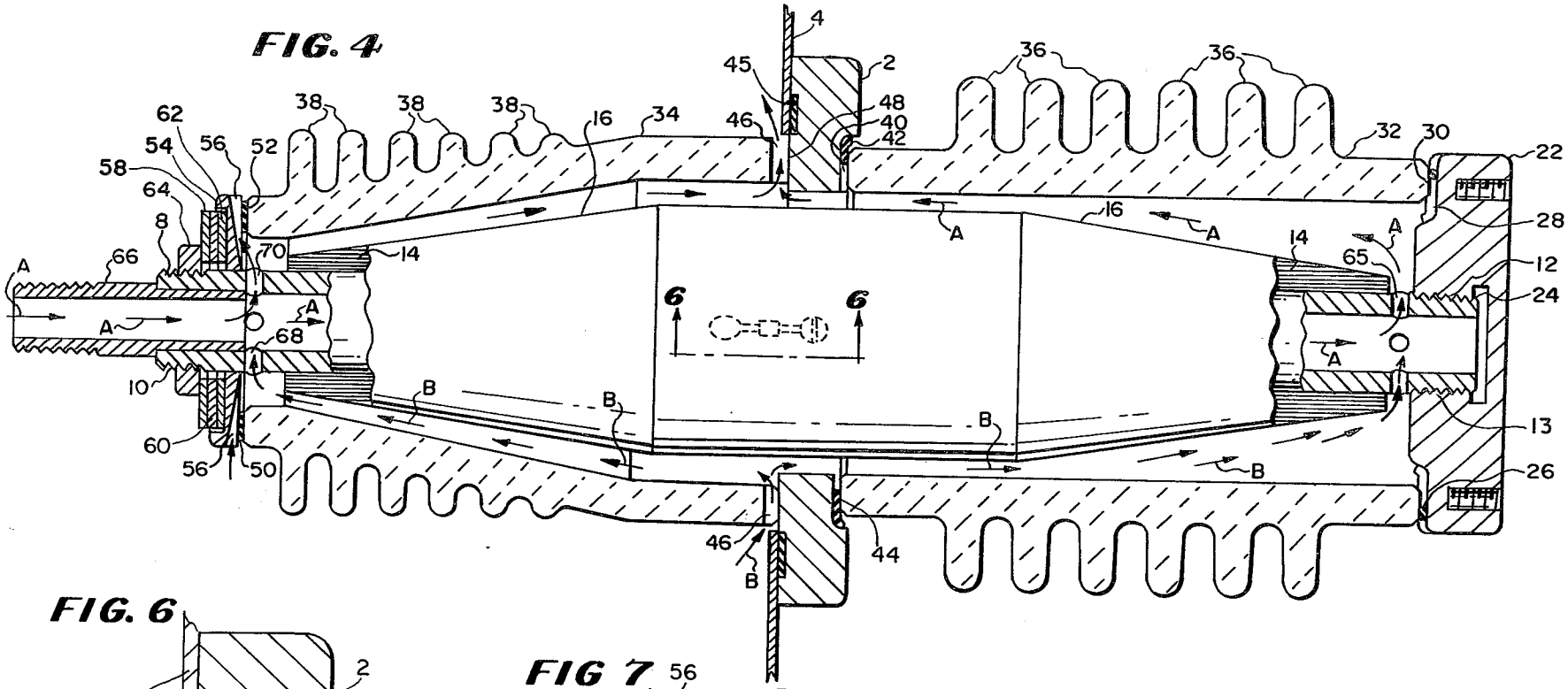
FIG. 4 is an enlarged side elevation view with portions in section of the oil-filled condenser bushing.

Referring now to the drawings, and more particularly, to FIGS. 1 and 4, the construction of a preferred embodiment of the oil-filled condenser bushing of this invention will be described. The oil-filled condenser bushing is assembled with a mounting plate 2 at the center. The mounting plate, an elevation view of which is shown in FIG. 2, is secured to the side-wall 4 of the housing enclosing the electrical device for which the bushing is to provide through the wall electrical connection. As viewed in FIGS. 1 and 4 the interior of the housing which is filled with a dielectric liquid 6 such as mineral oil or chlorinated diphenyl is to the left of the side-wall 4.

The bushing assembly includes a central through conductor 8 which comprises a hollow cylindrical member or pipe having external threaded portions 10 and 12 at each end. The central portion of conductor 8 is wrapped with alternating layers of conducting and non-conducting materials to form a condenser structure 14. The conducting layers are formed of a metallic foil, while the insulating or non-conducting layers may be formed of any suitable fiber such as KRAFT paper which is capable of oil impregnation. Adjacent conducting layers in condenser structure 14 are not electrically connected. As a result, the condenser structure serves as a voltage divider. The innermost layer, therefore, assumes the potential of central conductor 8 (which is, of course, that of the electrical device to which it is connected). The outer layer is electrically connected to mounting plate 2 which is in turn connected to sidewall 4 of the housing and is therefore generally at ground potential. The series capacitor effect of the intermediate foil and paper layers produces a voltage gradient between the potential of conductor 8 and ground. The alternating layers of conducting and insulating materials wound on central conductor 8 are formed of sheets of decreasing widths producing tapered end portions 16 of condenser structure 14.

Figure 6:
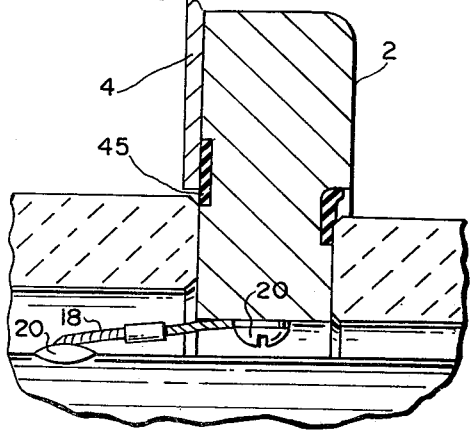
FIG. 6 is an enlarged partial cross-sectional view illustrating in detail the manner of connecting the condenser portion of the bushing assembly to the mounting flange.

Referring to FIG. 6, the method of grounding or electrically connecting the outermost conducting layer to mounting plate 2 is shown. A conductor 18 is soldered or welded at union 20 to the outermost conductive layer. The other end of conductor 17 is mechanically and electrically affixed to mounting plate 2 by a screw 20.

At the right hand of the bushing (i.e. the end outside the transformer enclosure) is a conductive enclosure member 22 which defines a centrally located cylindrical recess 24 which bears an internal thread 13. Threaded end portion 12 of central conductor 8 is received by threaded portion 13 and a resilient annular sealing member 26 is positioned within an annular recess 28 defined in the outer periphery of the inner surface of enclosure member 22. An annular flat surface 30 at the end of a cylindrical insulating member 32 abuts the other surface of sealing member 26. Thus, when compressive force is applied between end enclosure member 22 and cylindrical insulating housing 32, a fluid-tight seal is formed between the two by the compression of sealing member 26. Cylindrical insulating housing 32 and a similar cylindrical insulating housing 34 mounted on the opposite side of mounting plate 2 are formed of porcelain or other suitable insulating material. In accordance with known fabrication techniques, in order to increase the "voltage creepage length" along the outer surface of insulating housing 32 between mounting plate 2 and conductive enclosure member 22, the outer surface of insulating member 32 is provided with a series of annular rings 36. These annular rings also increase the external surface area of the insulative housings providing increased heat transfer. Similarly, in order to increase the external voltage creep distance along its outer surface and improve heat transfer, insulating housing 34 includes a plurality of similar annular rings 38.

An annular recess 40 on the outer surface of mounting plate 2 supports a resilient washer 42. The end of insulating housing 32 defines a flat annular surface 44 for engaging resilient sealing member 42 when the bushing connector is assembled. Similarly, housing 34 defines a flat surface 48 which abuts the inner surface of the mounting plate 2. A plurality of notches 46 defined in annular flat surface 48 provide flow paths for cooling liquid between the interior and exterior of insulating housing 34. Since the mating surface of insulating housing 34 is notched for liquid flow, no sealing member is provided between the face of mounting plate 2 and the abutting annular flat surface 48. A sealing member 45 is interposed between the mounting plate 2 and the sidewall 4.

Figure 7:
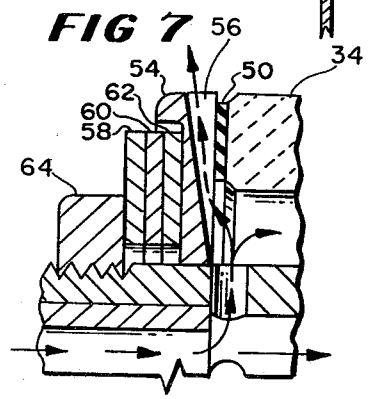
FIG. 7 is a large partial cross-sectional view of the clamping mechanism shown at the left end of FIG. 4.

With central conductor 8 threaded into enclosure 22, and with insulating housings 32 and 34 and mounting plate 2 assembled thereon as previously described, a resilient sealing member 50 is placed against an annular end surface 52 of insulating housing 34. A ring-shaped member 54 having a plurality of radially extending grooves 56 formed therein, shown best in FIGS. 3 and 7, is assembled over central conductor 8 and engages sealing member 50. Three Bellville washers 58, 60, 62 are assembled over the inner end of central conductor 8 and a nut 64 is threaded onto threaded end 10 of central conductor 8. Nut 64 is tightened onto conductor 8 creating a compressive force along the axis of conductor 8. As a result, annular sealing members 26, 42, and 50 are compressed and a liquid tight enclosure with the exception of the above described apertures results. A threaded extension 66 is received in the inner end of the central conductor 8 to extend its length.

Having thus described in general terms the overall construction of the oil-filled condenser bushing, the specific aspects thereof which provide for the convective flow of cooling the dielectric liquid therethrough will be considered. Generally, as viewed in FIG. 4, the flow of the liquid is from the left to the right and from the top to the bottom. This general flow direction is brought about by the temperature rise of the oil in the bushing which in turn is caused by the current flow through central conductor 8. As indicated by the arrows labeled A, one path of dielectric liquid flow is through central conductor 8 from left to right and then out of the central bore through an aperture 65 at the outer end of the connector bushing and back to the left passing over the surface of tapered condenser 14 and out through notch 46 located at the top of the condenser bushing. Further, the outer surface of tapered condenser 14 is spaced from the inner walls of insulating housings 32 and 34 allowing the dielectric liquid to circulate thereabout. Thus, as indicated by the arrow B, fluid may enter the notch 46 at the bottom of the bushing and flow directly around the central portion of tapered condenser 14 and out upper notch 46. It may also flow outward in each direction as indicated by arrows B. Further, the liquid dielectric fluid may enter the groove 56 at the bottom of the V-shaped member 54, and either flow upwardly generally around the outer surface of tapered condenser 14, or it may pass through lower aperture 68 of central conductor 8 and through the center bore of connector 8 along with the flow A. It may also pass out through upper aperture 70. The portion of the fluid which flows through aperture 70 and the portion circulating around central conductor 8 may flow along the upper surface of tapered condenser 14 to upper notch 46, or it may exit through upper radial grooves 56. This last flow pattern is more particularly illustrated by the arrows in FIG. 7.

Figure 8:
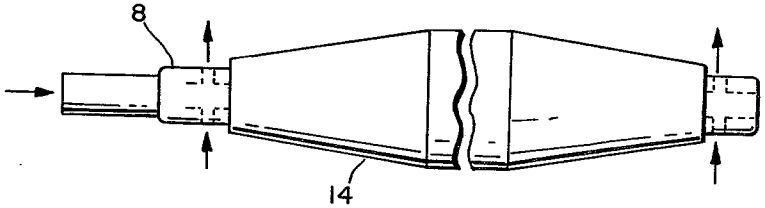
FIG. 8 is a schematic diagram of the condenser bushing showing the oil flow paths.

If due to heavy current flow the central conductor 8 should become considerably warmer than the general temperature of the dielectric liquid 6, the flow pattern may be that shown in FIG. 8, wherein the flow enters at the left end, and exits from all of the apertures in the cental conductor both at the left and at the right end.

With the foregoing understanding of multiple path fluid flow through the present invention bushing, an important advantage becomes apparent. In contrast to the prior art structures which circulated fluid through a predetermined path, the present invention bushing permits fluid convection to supply greater circulation to the areas of the conductor bushing which are the hottest.

By way of example, should a "hot-spot" occur at the outer end of the bushing (i.e. in the vicinity of end/closure 22), a greater portion of the fluid flow entering aperture 46 at the bottom would flow outward to pass over the hot spot.

It will be apparent to those skilled in the art that while what has been described is considered at present to be the preferred embodiment of this invention, in accordance with the patent statutes, changes may be made in the disclosed oil-filled condenser bushing without actually departing from the true spirit and scope of this invention.

I claim:

1. In an electrical apparatus in which at least one electrical component is contained within a dielectric fluid filled enclosure having an access aperture, and in which a conductive bushing connector is carried by said enclosure and extends through said access aperture for the purpose of facilitating electric current passage between the interior and exterior of the dielectric fluid filled enclosure, said conductive bushing connector comprising:

an elongated central conductor having first and second end portions, an axial passage, and a first plurality of passages oriented transversely to said axial passage with at least one of said first plurality of passages located at each end of said conductor to communicate the interior of said axial passage with the exterior of said conductor;

first and second terminal means for making electrical connections to said first and second end portions respectively; and insulative housing means, having an axial length sufficient to enclose a substantial portion of said elongated central conductor including said one passage at each end of said conductor and having an outer wall, for defining an interior cavity overlying a portion of said elongated central conductor, said outer wall having a second plurality of passages between said interior cavity and that portion of the exterior of said outer wall which is within said dielectric fluid filled enclosure whereby fluid is free to flow between said dielectric fluid filled enclosure and said central conductor, said second plurality of passages including a first port and a second port with said second port being disposed at a different vertical elevation than said first port, said first and second pluralities of passages and said interior cavity of said insulative housing means cooperating to provide a plurality of fluid convection paths permitting the dielectric fluid to circulate into and out of said housing means and about said elongated central conductor in a convective flow pattern which varies in response to the temperature gradients in and about said elongated central conductor.

2. In an electrical apparatus in which at least one electrical component is contained within a dielectric fluid filled enclosure having an access aperture and in which a conductive bushing connector is carried by said enclosure and extends through said access aperture for facilitating electric current passage between the interior and exterior of the dielectric fluid filled enclosure, said conductive bushing connector comprising:

an elongated central conductor having first and second threaded end portions, an internal axial passage, and a first plurality of fluid passage apertures oriented transversely to said axial passage with at least one aperture at each end of said central conductor, said elongated central conductor extending through the access aperture for approximately half of its length;

a first insulative housing, positioned without the enclosure, enclosing a portion of said elongated central conductor;

a terminal having a threaded portion cooperating with said first threaded end portion of said elongated central conductor;

first sealing means, interposed between said terminal and said first insulative housing, for providing a fluid-tight seal therebetween;

a substantially planar center flange member, having a center aperture encircling said elongated central conductor, which is interposed between said first insulative housing and the exterior surface of the dielectric fluid filled enclosure;

second sealing means, interposed between said first insulative housing and said center flange member, for providing a fluid-tight seal therebetween;

third sealing means, interposed between said center flange member and the dielectric fluid filled enclosure, for providing a fluid-tight seal therebetween;

a second insulative housing, positioned within said dielectric fluid filled enclosure, enclosing a portion of said elongated central conductor, said second insulative housing having a second plurality of fluid passage apertures to provide a flow path between its interior and exterior;

terminal means having a threaded member cooperating with said second threaded end portion of said elongated central conductor and having an apertured member defining a third pluraltiy of fluid passage apertures to provide a flow path between the interior of the dielectric fluid filled enclosure and that portion of said elongated central conductor between its threaded end portions, for connecting the electric component to said central conductor; and fourth sealing means, interposed between said terminal means and said second insulative housing, for providing a fluid-tight seal therebetween, said terminal and said terminal means cooperating with said elongated central conductor to maintain a compressive force upon said first and second insulative housings, said first, second, third and fourth sealing means, and said center flange member such that said first and second insulative housings provide a fluid bowl about said elongated central conductor including said at least one aperture at each end of said central conductor, said first, second and third pluralities of fluid passage apertures cooperating to permit a convective flow of said dielectric fluid into and out of said fluid bowl and about said elongated central conductor which varies with the temperature gradients in and about said elongated central conductor.

* * * * *